US005755166A

United States Patent [19]

Andersson

[11] Patent Number: 5,755,166

[45] Date of Patent: May 26, 1998

[54] METHOD AND DEVICE FOR AFTER-BURNING OF PARTICULATE FUEL IN A POWER PLANT

[75] Inventor: Karl-Erik Andersson, Finspong, Sweden

[73] Assignee: ABB Carbon AB, Finspong, Sweden

[21] Appl. No.: 666,386

[22] PCT Filed: Dec. 19, 1994

[86] PCT No.: PCT/SE94/01219

§ 371 Date: Oct. 9, 1996

§ 102(e) Date: Oct. 9, 1996

[87] PCT Pub. No.: WO95/17628

PCT Pub. Date: Jun. 29, 1995

[30] Foreign Application Priority Data

Dec. 21, 1993 [SE] Sweden ..... 9304224

[51] Int. Cl.[6] ..... F23D 1/00

[52] U.S. Cl. ..... 110/347; 110/245; 110/213; 110/214; 60/30.464

[58] Field of Search ..... 110/345, 245, 110/266, 210, 213, 214, 216, 347, 348; 60/39.464

[56] References Cited

U.S. PATENT DOCUMENTS

| | | | |
|---|---|---|---|
| 3,716,003 | 2/1973 | Battcock . | |
| 4,378,745 | 4/1983 | Flatland | 110/216 X |
| 4,688,521 | 8/1987 | Korenberg | 110/245 X |
| 4,730,563 | 3/1988 | Thornblad . | |
| 4,932,861 | 6/1990 | Keller et al. . | |
| 4,951,612 | 8/1990 | Gorzegno . | |
| 5,024,170 | 6/1991 | Santanam et al. | 110/347 X |

FOREIGN PATENT DOCUMENTS

| | | |
|---|---|---|
| 144 172 | 7/1988 | European Pat. Off. . |
| 321 809 | 6/1989 | European Pat. Off. . |
| WO 93/22600 | 11/1993 | WIPO . |

OTHER PUBLICATIONS

Combined Cycle Power Plants, Modern Power Systems, vol. 12, No. 5, pp. 53–55, May 1992.

*Primary Examiner*—Henry A. Bennett
*Assistant Examiner*—Susanne C. Tinker
*Attorney, Agent, or Firm*—Pollock, Vande Sande & Priddy

[57] ABSTRACT

In a power plant with combustion of particulate fuel in a fluidized bed, unburnt particles are after-burnt in a burner which is based on the principle of vortex collapse and coarser particles are separated in connection with the after-burning. Such a burner may be designed as a double-cone burner, wherein unburnt fuel particles are burnt. Larger particles move around in a helical movement inside the extension of the burner cone. A coarse particles separator integrated with the burner, is arranged and comprises a circular gap which is located near the extension of the burner cone and which collects coarser particles rotating at the side of the combustion zone of the burner. These separated particles, collected by the circular gap, are forwarded to a space which surrounds the burner and from where the separated coarser particles are returned to the primary combustion space, for example, to the fluidized bed in the plant. In this way, larger particles with possibly larger contents of unburnt fuel may be given additional residence time in the primary combustion space, where the degree of burnout of the fuel contents in the particles is considerably increased.

15 Claims, 6 Drawing Sheets

Fig. 4
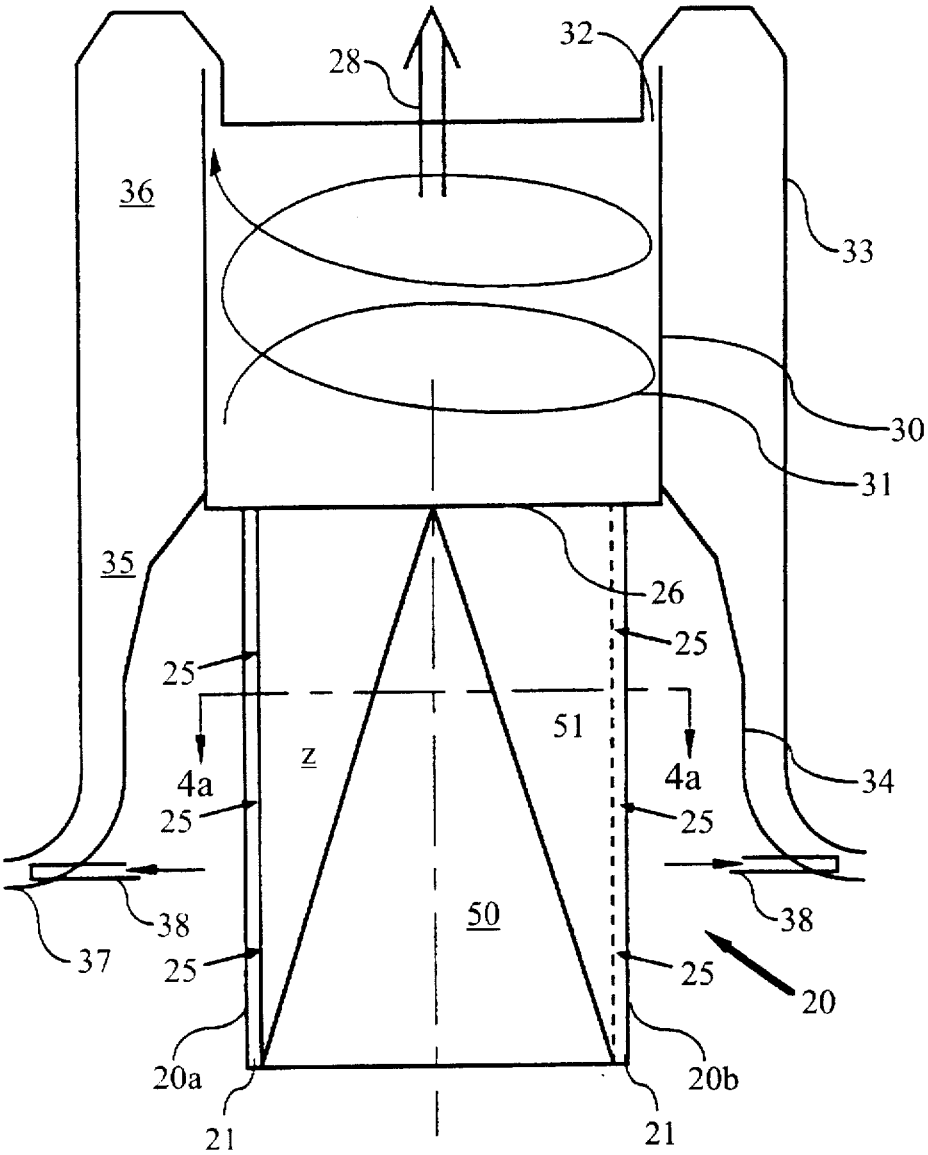
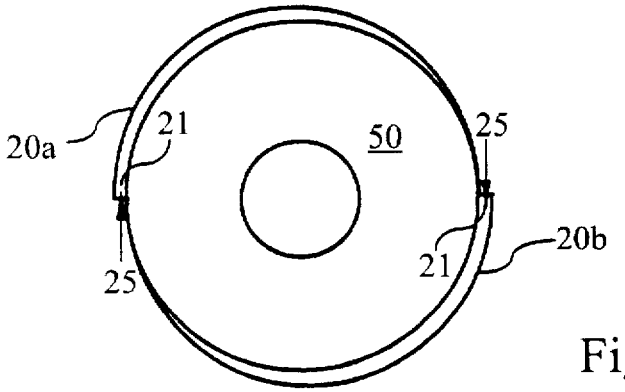
Fig. 4a

METHOD AND DEVICE FOR AFTER-BURNING OF PARTICULATE FUEL IN A POWER PLANT

TECHNICAL FIELD

The present invention relates to a method and a device for after-burning of more or less unburnt fuel particles in flue gases in a power plant preferably a PFBC power plant, which is fired with a particulate fuel. Further, the invention comprises a method and device, integrated with the afterburning, for separating coarser particles which are returned to a combustion chamber.

BACKGROUND OF THE INVENTION

In power plants which, in a primary combustion chamber are fired with a particulate fuel, for example coal, in a fluidized bed, the fuel particles reside for such a long time in the bed that all fuel in the particles is burnt before the particles leave the bed in the form of ash. It happens, however, that the flue gases leaving the bed and entering a freeboard above the surface bed bring with them material from the bed. This material may contain unburnt fuel particles, brought with the flue gases out of the combustor in which the combustion in the fluidized bed takes place. The flue gases from a power plant of the kind mentioned are cleaned in dust separators, usually of a cyclone type, before the gases are forwarded in clean form to a gas turbine for utilization of the energy in the flue gases.

The particles which contain unburnt fuel may, in any oxygen residues occurring, be burnt in the flue gases. This may take place in the form of fires downstream of the freeboard, for example in dust separators for the flue gases, which creates drawbacks in the system such as unbalances between different parallel-connected dust separators, erosion and sintering.

It is known to return material from dust separators to the bed to thus burn such unburnt fuel and hence increase the combustion efficiency. Examples of such return of coarse-separated particles are described in SE 451 501 (EP 233 630) and in U.S. Pat. No. 3,716,003.

Another possibility of solving the problem with unburnt particles entrained in the flue gases may be to locate an after-burner downstream of the primary combustion chamber. Such an after-burner is usually fired with a secondary fuel, for example gas or oil. Air or oxygen is supplied to the secondary combustion which allows a considerably higher temperature of the outflowing flue gases supplied to a gas turbine in the plant, whereby the efficiency in the gas cycle is increased, which is the main purpose of secondary combustion. At the same time, the secondary combustion contributes to non-burnt-out material from particles in the bed also being burnt out. A disadvantage in this connection, however, is that an additional fuel must be utilized. In addition, efforts for mechanical separation of dust particles in the flue gases downstream of the secondary combustion, at the high temperature then used, is difficult. As an example of after-burning may be mentioned the technique according to EP 144 172.

After-burning of unburnt fuel residues is also obtained with a device disclosed in U.S. Pat. No. 3,716,003, in which a vortex combustor of a cyclone type is used. The combustion takes place in the same chamber in which a vortex of flue gases is created. However, the mixing of unburnt fuel particles and the gas in this device is insufficient so that unburnt fuel particles do not encounter oxygen residues in the flue gases to a sufficient extent. This results in an incomplete after-burning. The aim is to achieve a combustion which is performed at a low gas speed and a high turbulence level. In a cyclone-type burner the burnable particles will be centrifuged out towards the shell surface of the cyclone and be burnt there, which results in the temperature of the cyclone wall becoming high. Since the combustion takes place inside a cyclone vortex, also the speed of combustion will also be high, which is undesirable.

A further method of reducing the quantity of unburnt particles, flowing with the flue gases out of the combustor, is to arrange firing with a complementary fuel in the freeboard above the bed surface, where nozzles for injection of a fuel are arranged, whereby the complementary fuel and non-burnt-out fuel particles in the freeboard are burnt in oxygen residues in the flue gases. Such a method is disclosed in the application PCT/SE93/00372. Also with the method described there, the disadvantage of having to use a secondary fuel exists.

SUMMARY OF THE INVENTION

The object of the present invention is to provide a method of burning non-burnt-out particles by means of a special type of burner which facilitates after-burning of particles without the addition of other fuel, and possibly also without the addition of oxygen other than that which is present in the flue gases. A further object of the invention is to separate coarser particles in connection with the after-burning and to return these coarser particles to the primary combustion space.

The present invention in a power plant, preferably a PFBC power plant, with a primary combustion chamber wherein a particulate fuel is burnt in a fluidized bed, and wherein unburnt particles leave the bed via the flue gases generated during the combustion, provides a method in which the unburnt particles are after-burnt in a burner based on the principle of vortex collapse and a separation of coarser particles in connection with the after-burning, and further a device for carrying out method.

According to the method, a burner is used which is based on the above-mentioned principle of vortex collapse. Such burners are known under the term "EV burners", sometimes also double-cone burners (see, e.g., Modern Power Systems, Vol. 12, No. 5, p. 55). This type of burner utilizes a vortex generator which comprises a conical or cylindrical shell with an inner space which has an increasing area with a circular or annular cross section in the flow of a medium through the vortex generator. A medium traversing the vortex generator creates therein a well-defined vortex which collapses at the outlet of the vortex generator, where the successively increasing area of the vortex generator abruptly ends.

As mentioned, the vortex generator has a conical or cylindrical shell, which is cut into halves along at least two of the generatrices of the shell, thus achieving at least two shell parts. At the respective dividing generatrix, the shell parts are displaced in relation to each other in the radial direction. This creates a gap between two adjoining shell parts along the generatrices along which the shell has been cut.

Air is supplied to the vortex generator from outside at the above-mentioned gaps, and flows inside the vortex generator towards an outlet at the widest part thereof. Fuel is supplied either in the form of gas along the gaps mentioned, or in liquid state at that part of the shell of the burner which is located opposite to the burner outlet in the axial direction. Because the vortex generator is formed with circular cross section and with an increasing area in the direction of flow of the media, a well-defined vortex of fuel and gas is generated which flows towards the outlet at a high speed. At the outlet of the vortex generator where the well-defined area increase suddenly ends, the vortex collapses. Since the intense mixing takes place between fuel and the oxygen of the air in the strong turbulence in the collapsed vortex, the fuel can now be burnt in the collapsed vortex. This type of burner constitutes prior art but is used during combustion of gases and possibly liquid fuels in connection with gas turbines and primarily to make the combustion efficient and to reduce emissions.

According to the invention, a burner for after-burning with a vortex generator of the type described above is located downstream of the bed, for example at the outlet of the flue gases from a freeboard, to which flue gases from the bed flow. The burner is attached with its outlet to the outlet of the combustor. The flue gases which leave the bed will thus be forced to flow through the gaps in the vortex generator of the burner, thus creating a strong slender vortex inside the burner. This slender vortex then collapses when leaving the vortex generator. Any unburnt fuel particles in the gas flow are then confronted, in the intensely turbulent region of the collapsed vortex, with oxygen residues in the outflowing flue gas. Because of the relatively high temperature (in a PFBC power plant about 850° C.), the residual fuel will self-ignite and be burnt. This results in the advantage that the fuel can be finally burnt without having to supply secondary fuels. If the presence of oxygen in the flue gases is insufficient, oxygen may possibly be supplied to the burner to ensure that all fuel is burnt. The combustion takes place in the turbulent zone immediately downstream of the vortex generator, whereby the combustion zone may be located downstream of the combustor; for example in the associated flue gas duct. In a cyclone-type after-burner, the combustion takes place inside the burner itself with the disadvantages described above.

It is, of course, possible to place the burner at an optional location downstream of the bed, for example, in a flue duct or the like.

Fuel particles, for example coal particles, which are burnt in the manner described are of the order of size that the forces of flow in the gas are able to bind the particles. Larger particles which cannot be captured in the vortex generated in the vortex generator run around in a helical movement immediately inside the envelope surface of the burner. According to the invention, a coarse separator, integrated with the burner, is arranged for these larger particles which are not captured by the gas vortex. This separator comprises a cylindrical extension which is arranged near the outlet of the burner and which terminates in a narrow circular gap formed inside the periphery of the cylinder at the outlet. The gap collects the coarser particles which, because of the cyclone effect of the burner, are rotating along the circular periphery of the cylinder. These separated particles, collected by means of the circular gap, are forwarded to a space surrounding the burner, from where the separated coarser particles are returned to the primary combustion chamber, for example to the fluidized bed in a PFBC power plant. In this way, these large particles, with possibly larger contents of unburnt fuel, may be given additional residence time in the primary combustion chamber, whereby the degree of burnout of the fuel contents in the particles is considerably increased.

By utilizing the method according to the invention, the risk of fires downstream of the freeboard of the combustor is eliminated. This means that the risk of fires downstream of the primary combustion space, in, for example, cyclone-type dust cleaners, can be disregarded, which means that these dust cleaners may be refined and improved with respect to their flow characteristics.

A disadvantage with the use of a burner according to the method may seem to be that a pressure loss arises upon the passage of the flue gases through the burner. This is a disadvantage because the gas turbine in a subsequent stage is then fed with gases of lower pressure. If, on the other hand, a combustion of small coal particles is achieved in the turbulent region after the burner, this pressure drop will for the most part be compensated. Through the combustion, the volume flow of the gas and hence the pressure will increase.

An additional advantage with coarse separation of the coarser particles, which are returned to the primary combustion chamber, is that these particles do not contribute to erosion of equipment and of gas channels downstream of the coarse separator, which contributes to reduction of the service requirement. Further, when using a technique according to the invention, the dust load in cyclones or corresponding dust separators is reduced.

DESCRIPTION OF THE PREFERRED EMBODIMENTS

A number of preferred embodiments of the invention will be described with reference to the accompanying drawings.

Figure 1:
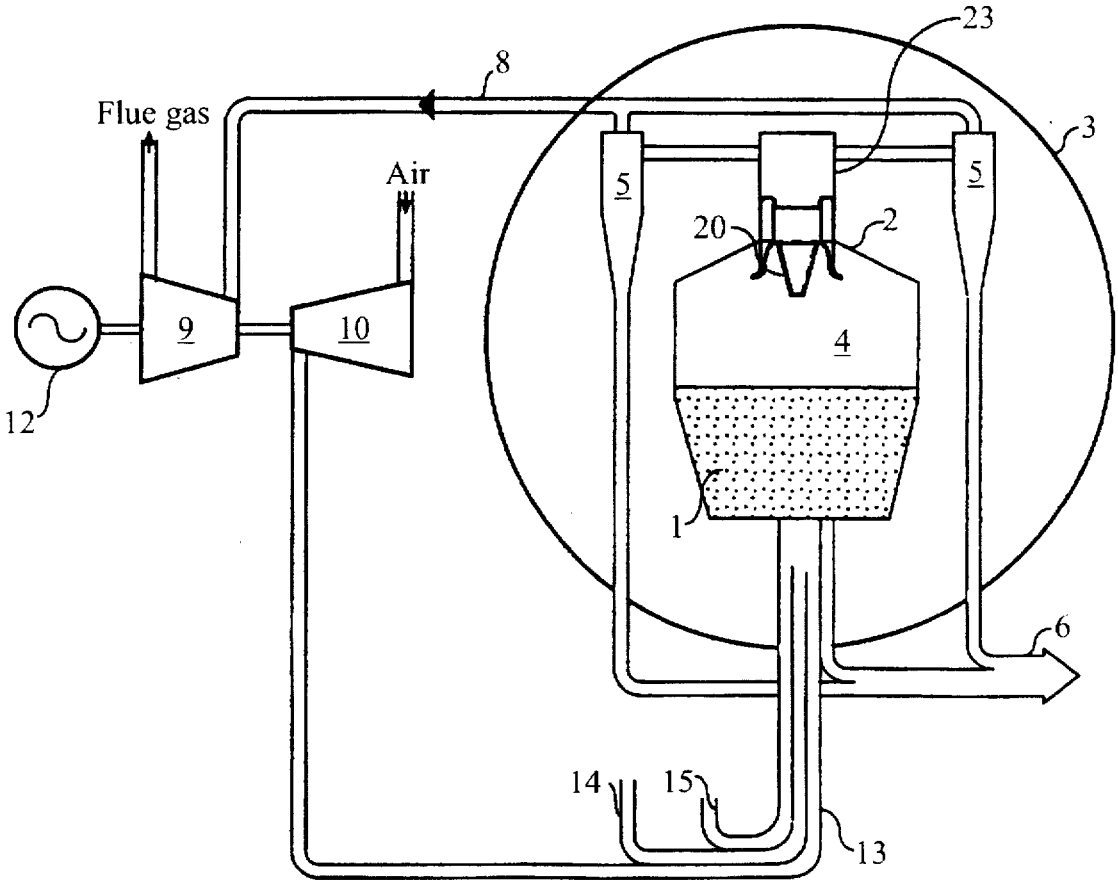
FIG. 1 schematically shows the location of a double-cone burner with surrounding dust cleaners at an outlet for flue gases in a power plant with combustion of particulate fuel in a fluidized bed.

FIG. 1 shows a general process diagram of a plant for which the present invention is intended. In this plant a fuel is burnt in a fluidized bed 1 in a combustor 2 enclosed in a pressure vessel 3. The flue gases which are formed during the combustion in the bed 1 pass a freeboard 4 above the bed 1 and are cleaned of dust in dust separators 5, exemplified in the figure by cyclones. Separated dust from the dust separators 5 and ash from the bed 1 are discharged via a schematically shown outlet 6 to storage containers (not shown). The cleaned flue gases from the dust separators 5 are passed via a flue gas conduit 8 to a gas turbine 9, which drives a compressor 10 as well as a generator 12 for generating electric energy. The compressor 10 compresses air which is supplied to its inlet to a pressure of 4–16 bar (the lowest value at low load), whereupon the compressed air via the conduit 13 is supplied to the pressure vessel 3 for pressurization thereof and is forwarded to the bed 1 as combustion air and fluidization gas.

In the exemplified plant, the bed 1 is supplied with particulate coal via a conduit 14, whereas absorbent for desulphurization of the fuel is added via a supply conduit 15.

The plant normally also comprises a steam circuit (not shown), to which steam is generated in tubes immersed into the bed 1.

In the upper part of the freeboard 4 above the bed 1 at the outlet of the freeboard into a flue gas channel 23, an afterburner in the form of a double-cone burner 20 is mounted according to the example.

Figure 2:
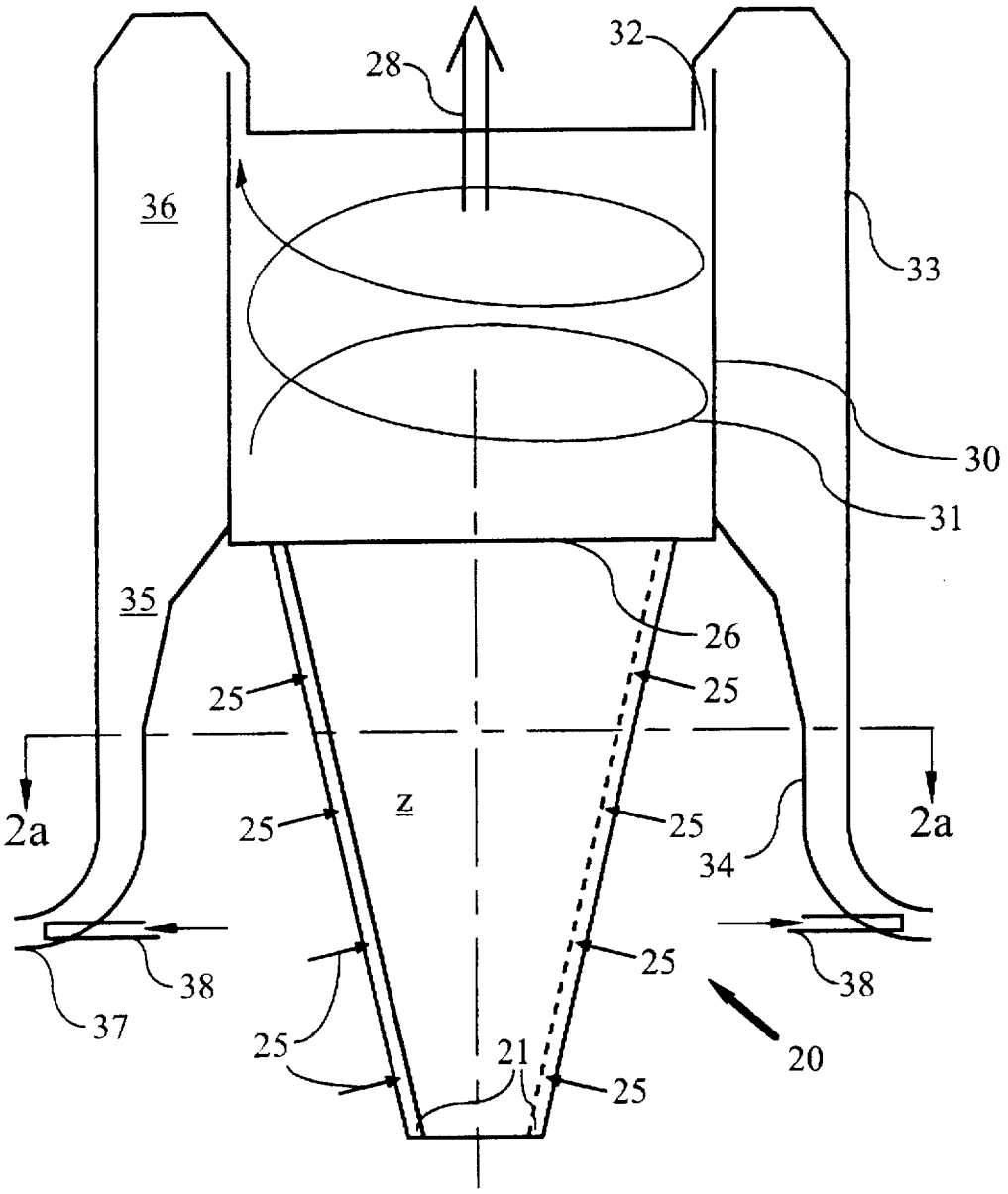
FIG. 2 shows an axial cross section through an embodiment of the double-cone burner with associated coarse separators according to the invention.
Figure 2A:
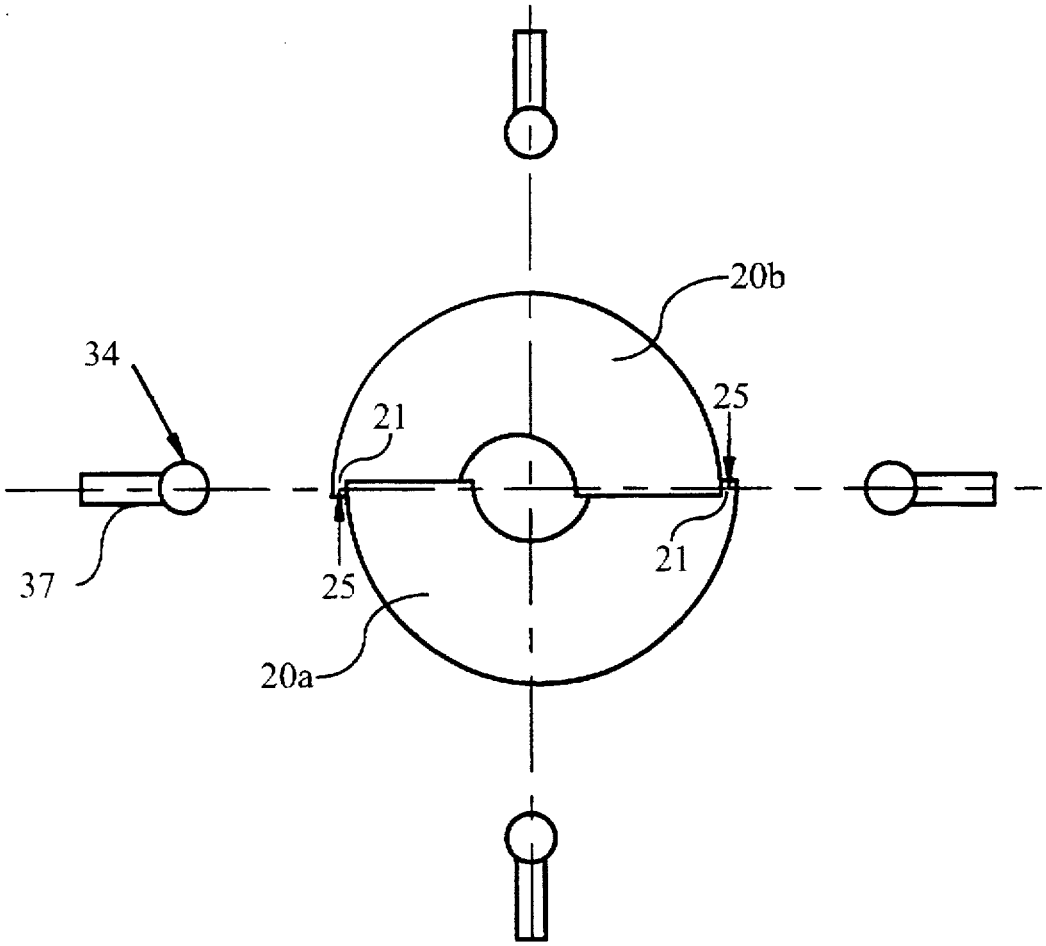
FIG. 2*a* shows a plan view of the double-cone burner with associated coarse separators from above in a radial section.

The function of the double-cone burner 20 will be explained with reference to FIGS. 2 and 2*a*. The burner 20 is composed of a cone which is cut into two halves along an axial cross section, two conical halves 20*a* and 20*b* thus being formed. These two conical halves 20*a* and 20*b* are radially displaced in relation to each other, thus forming two gaps 21 along two opposite generatrices of the conical envelope surface of the burner 20. The two cone halves 20*a*, 20*b* constitute the vortex generator of the burner and thus define the space wherein the vortex of the burner is generated.

According to the invention, unclean flue gases are forced to flow through the burner 20 before the gases can be brought further from the primary combustor 2. The flue gases flow into the burner 20 via the gaps 21. The inflowing flue gases are symbolized by the arrows 25 in the figures. Because of the displaced cone halves 20*a*, 20*b* of the burner 20, the gases are forced to flow towards and through the gaps of the double cone in a direction tangential to the cross section of the burner. This leads to the generation, in a known manner, of a slender vortex in the vortex generator of the burner 20 along the symmetry axis of the burner. At the orifice 26 of the burner, where the burner symmetry ceases, this slender vortex collapses in the axial extension of the cone. Due to the very powerful mixing operations which take place between flue gases and the unburnt particles contained in the flue gases, in the heavy turbulence in the region where the vortex collapses, a combustion of unburnt fuel particles will take place where these fuel particles are subjected to contact with oxygen residues, or with oxygen possibly added to the burner 20. This combustion is then restricted to the region of the vortex collapse. Any fuel occurring is self-ignited at the relatively high temperature (in a fluidized bed plant usually at about 850° C.). The arrow 28 indicates the flow of the flue gas. By means of the after-burning according to the invention, the risk of undesired fires in flue gas paths downstream of the burner 2 can be eliminated.

Contrary to the situation which prevails in connection with after-burners with vortex combustion in a burner of cyclone type, the vortex generated in a burner according to the invention moves in the same direction all the time and is not forced to make the 180 degree change in direction which is the case in a cyclone-type vortex burner.

At the orifice 26 of the burner cone 20, where the gas/fuel mixture collapses, a combustion zone is obtained where fuel particles captured in the gas flow are burnt. Coarser particles, which do not accompany the movements of the gas vortex, sweep in a known manner, because of the cyclone effect, along the inner surface of a cylindrical extension tube 30 in a helical movement 31, as indicated in FIG. 2. At the opening of the extension tube 30 into a flue gas channel 23 in the plant, a narrow circular gap 32 is formed. This circular gap 32 captures the coarser particles which rotate in the helical movement 31 in the extension tube 30 and conducts the flow of coarser particles further to an outer cylindrical vessel 33, which surrounds the extension tube 30 which thus constitutes the inner wall in the vessel 33. The rotary motion of the particles in the upper part of the vessel 33 is slowed according to the invention by four legs 34, the upper parts of which are formed as conical or cone-like pockets 35, to which the annular space 36 in the vessel 33 conforms. To obtain a flow of gas, ash and coal particles through the vessel 33 to the leg 34 and further out through the orifices 37 of the legs, ejectors 38 are used at the orifices 37 of the legs. The orifices 37 of the legs are extended down into the freeboard 4 of the burner 2 to an optional level and directed in different directions to distribute gas and particles flowing out of the orifices 37 of the legs, in the freeboard 4.

Figure 3:
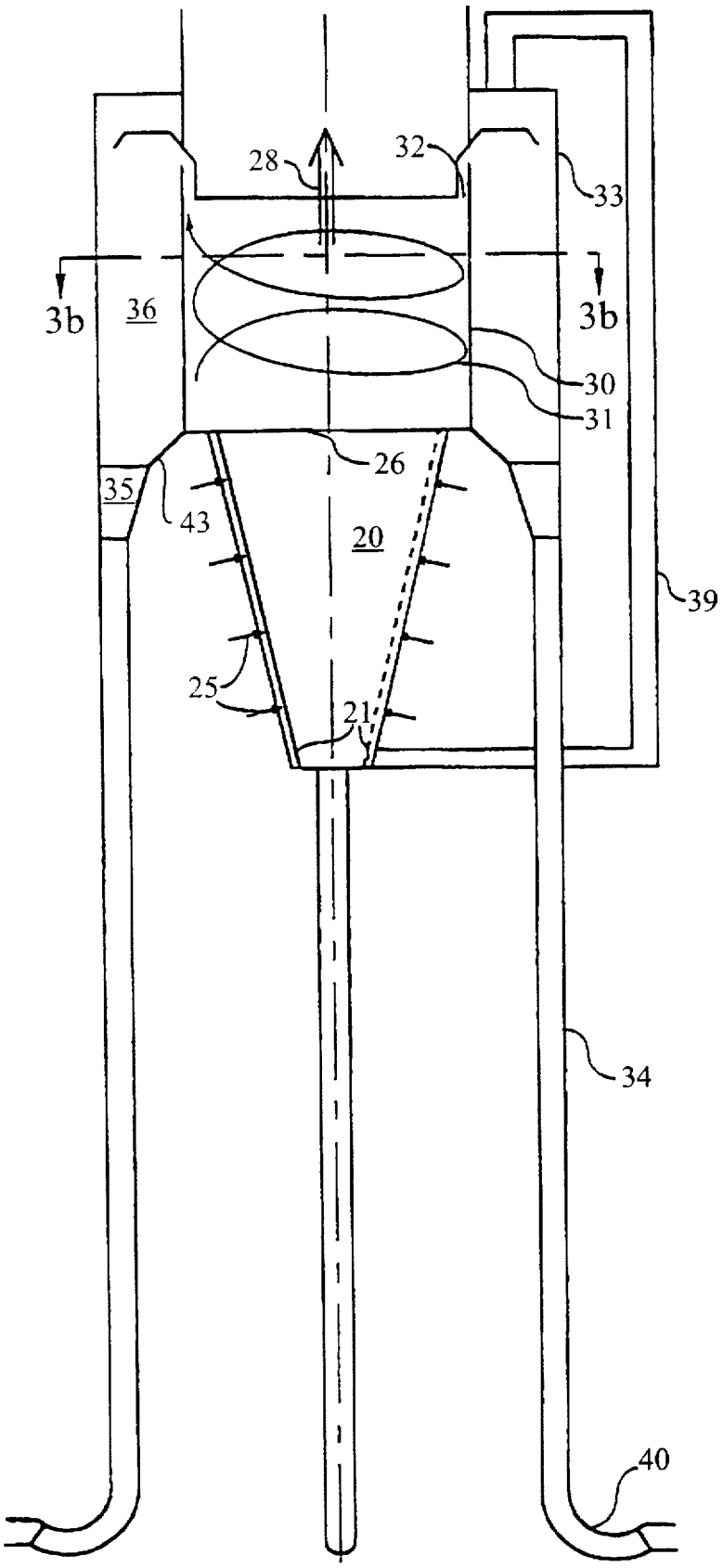
FIG. 3 shows an alternative embodiment of the double-cone burner with associated coarse separators according to the invention, wherein legs from the coarse separator extend down into the fluidized bed of the plant.

In one modification of the coarse separator according to FIG. 3, an embodiment is shown in which the legs 34 from the vessel 33 extend all the way down into the bed 1. This means that separated particles, collected at the gap 32 and brought to the annular space 36, will be slowed down at the point where this space 36 changes into the conical pockets 35, whereupon the particles fall down into the long legs 34, in which a standing column of particles, a so-called standpipe, is created.

To achieve a flow through the vessel 33, a feedback coupling is made by means of a pipe connection 39 between the upper part of the vessel 33 and a low-pressure zone in the burner 20. The function of this feedback coupling is to create a low pressure in the vessel 33. The reason for this is that the vortex generated in the cone burner 20 creates, locally in the lower part of the burner 20, a lower pressure.

According to the embodiment in FIG. 3, the lower part of the leg 34 may be given a plurality of different shapes. What is shown in FIG. 3 is a well-tried method, in which the legs terminate in the bed in a particle trap in the form of a knee 40 with the same function as a water trap. The knee 40 immersed into the bed 1 permits particles standing in the leg 34 to be pressed out into the bed, whereby fuel residues contained in the particles may be burnt in the bed 1. In the fluidized bed the particles have a lower density than the non-fluidized particles standing in the leg, which means that a particle flow from the leg 34 out into the bed 21 is controlled by itself. Other embodiments of the particle trap are also possible. As an example may be mentioned a plate at the termination of the leg 34, in which case an annular horizontal gap feeds out dust.

One advantage of an arrangement with leg orifices immersed into the bed and designed according to FIG. 3 is that a larger efficient height of particles in the legs 34 is obtained with this solution than with other embodiments, thus attaining the desired function with greater certainty. The embodiment with four legs 34 also spreads the returned particles over a larger region in the bed 1.

Figure 3B:
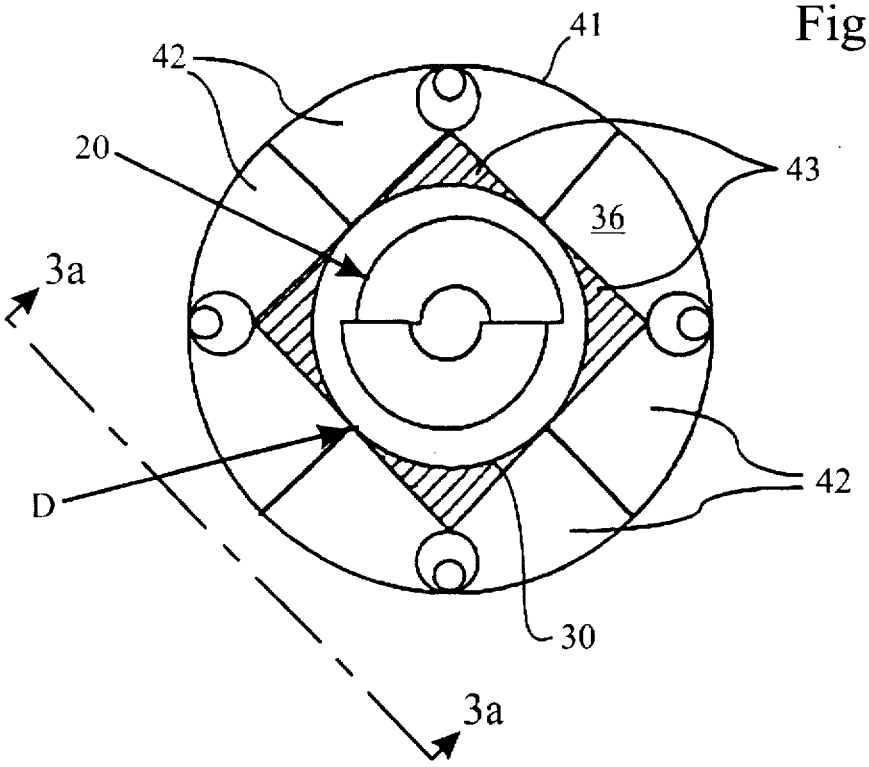
FIG. 3*b* shows a radial section through the double-cone burner with associated coarse separators according to FIG. 3, and FIGS. 4 and 4*a* illustrate an embodiment of the after-burner according to the invention, wherein the conical shell is replaced by a cylindrical shell and wherein, at the same time, a cone inside the cylindrical shell gives the vortex generator its increasing area.
Figure 3A:
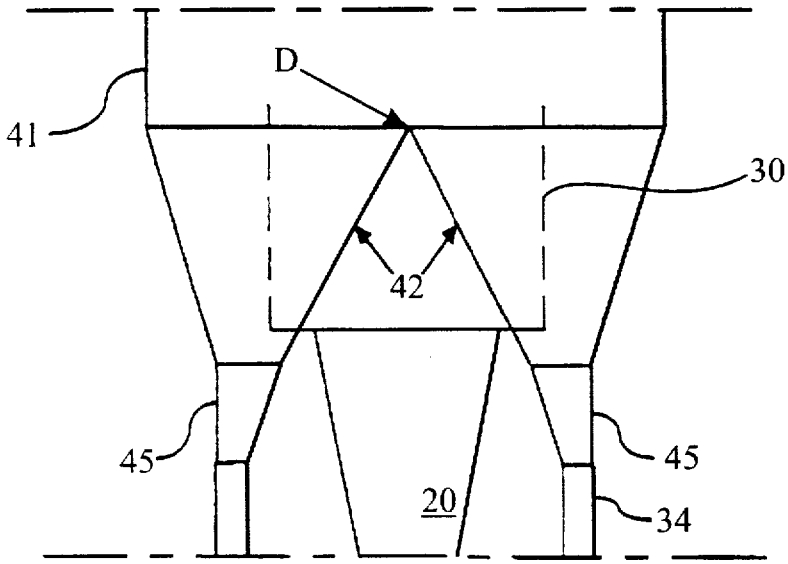
FIG. 3*a* shows a side view of the double-cone burner with associated coarse separator according to FIG. 3.

The embodiment of the vessel 33 and its transition into the legs 34 is clear from FIGS. 3*a* and 3*b*, which illustrate that the vessel 33 externally exhibits a cylindrical wall 41. The transition from the annular space 36 of the vessel 33 between the cylindrical walls 41 and 30 to the legs 34 is achieved by means of plane plates 42 and conical plates 43. These plates 42, 43, 44 conform to eccentric conical parts 45, which in turn form the transition into the tubular legs 34.

The burner 20 with its integrated coarse separator may be placed at alternative locations in the plant. There is nothing preventing it from being located in the flue gas channel 23 or in flue gas channels downstream of the combustor 2.

The number of conical elements 20*a*, 20*b* in the burner 20 may, of course, also be varied. Three or more conical elements, displaced in the radial direction in relation to each other in such a way that gaps for the supply of fuel and gas are formed in a manner corresponding to that of a double-cone design, may be arranged where this is desired to create a burner which utilizes the principle based on vortex collapse.

In an alternative embodiment, the shell of the after-burner 20 may be cylindrical, as shown in FIGS. 4 and 4*a*. In this case, the vortex generator is arranged with an outer cylindrical delimiting surface in the form of the shell parts 20*a*, 20*b* and an inner delimiting surface in the form of a cone 50 disposed inside the cylinder shell and along the axis thereof. Cone 50 gives the space 51 between the outer and inner delimiting surfaces an increasing annular area in a direction towards the outlet 26, since the tip of the cone 50 is directed toward the outlet 26.

After the cylindrical part 36 of the coarse separator, the existing vortex is eliminated by means of a number of plane plates 42, 43, 44. This results in greater freedom to choose a suitable dimension for the return piping, that is, the legs 34 for particles to the primary combustion chamber compared with a conventional cyclone where the magnitude of the tangential velocity at the transition from cone to leg, must be taken into consideration.

As an alternative to the coarse separator described, a corresponding separator with only two legs 34 may be arranged.

I claim:

1. A method for after-burning and simultaneous separation of coarser particles in a power plant in which a particulate fuel is burnt in a fluidized bed enclosed within a combustor from where flue gases formed during the combustion are passed via a channel to a gas turbine, said method comprising the steps of:

a) burning unburnt fuel particles contained in the flue gases downstream of the fluidized bed in a burner comprising a vortex generator into which the flue gases flow and are set in rotation therein to form a vortex, b) arranging the vortex generator having an increasing area inside a shell with a substantially circular cross section in the direction of flow of the vortex so that the after-burning takes place at the termination of the vortex generator where the vortex collapses, c) supplying the flue gases to the vortex generator via at least two gaps arranged along at least two of the generatrices of the shell, and d) separating coarser particles passing the burning in a separator device integrated with the burner.

2. A method according to claim 1, wherein the method is applied to a PFBC power plant.

3. A method according to claim 1 further including supplying additional air or oxygen to the burner at the termination of the vortex generator to ensure more complete combustion.

4. A method according to claim 1 further including feeding back separated coarser particles to a primary combustion space.

5. A device for carrying out after-burning and simultaneous separation of coarser particles in a power plant in which a particulate fuel is burnt in a fluidized bed enclosed within a combustor from where flue gases formed during the combustion are passed via a channel to a gas turbine, the device including a burner comprising a vortex generator having a conical or cylindrical shell which constitutes a limiting surface for the vortex generator, the shell being divided into at least two parts which are displaced relative to each other in the radial direction so as to form at least two gaps along at least two of the generatrices of the shell, the flue gases being supplied to the vortex generator through said gaps.

6. A device according to claim 5, wherein the shell of the vortex generator is cylindrical and encloses a cone, the axis of which coincides with the axis of the cylindrical shell and wherein the tip of the cone faces the outlet of the vortex generator, whereby the flue gas vortex is created in the space between the cone and the shell.

7. A device according to claim 5, wherein the burner is surrounded by a separator device for separating coarse particles passing at the side of a collapsed vortex of flue gases generated in the burner.

8. A device according to claim 5, wherein the burner is located near an outlet for flue gases from a freeboard downstream of the bed in the combustor.

9. A device according to claim 7, wherein the burner is placed inside a flue gas channel downstream of the freeboard.

10. A device according to claim 7, wherein the separator device for separating coarser particles comprises an extension tube connected to the outlet of the burner and the extension tube at its termination exhibits a particle-collecting gap, which leads collected particles and a small flow of gas to a vessel.

11. A device according to claim 10, wherein the vessel is annular and surrounds the extension tube.

12. A device according to claim 10, wherein the vessel in the downstream direction includes pockets which change into legs.

13. A device according to claim 12, wherein the legs open out at an optional height into a freeboard and a particles/gas flow is maintained via the gap, the vessel, the legs and let out into the freeboard by means of ejectors arranged at the orifices of the legs.

14. A device according to claim 12, wherein the legs open into the bed and terminate in a dust trap.

15. A device according to claim 14, wherein a feedback coupling is made between the vessel and a part of the burner facing the flue gas flow in order to create a low pressure in the vessel and a flow of particles and gas to the vessel downstream of the burner outlet.

* * * * *